US008081139B2

(12) United States Patent
Schmidt et al.

(10) Patent No.: US 8,081,139 B2
(45) Date of Patent: Dec. 20, 2011

(54) STRUCTURES AND METHODS FOR MOUNTING AN ANTENNA

(75) Inventors: Jason S. Schmidt, Centennial, CO (US); David Lettkeman, Parker, CO (US); Eric Bolze, Phoenix, AZ (US)

(73) Assignee: DISH Network L.L.C., Englewood, CO (US)

( * ) Notice: Subject to any disclaimer, the term of this patent is extended or adjusted under 35 U.S.C. 154(b) by 454 days.

(21) Appl. No.: 12/483,016

(22) Filed: Jun. 11, 2009

(65) Prior Publication Data

US 2009/0315804 A1 Dec. 24, 2009

Related U.S. Application Data

(60) Provisional application No. 61/074,352, filed on Jun. 20, 2008.

(51) Int. Cl.
*H01Q 1/12* (2006.01)

(52) U.S. Cl. ..... 343/878; 343/892; 343/882; 248/285.1; 248/286.1

(58) Field of Classification Search ..... 343/878, 343/880, 881, 882, 890, 891, 892; 248/274.1, 248/285.1, 286.1

See application file for complete search history.

(56) References Cited

U.S. PATENT DOCUMENTS

| | | | | |
|---|---|---|---|---|
| 4,698,640 | A * | 10/1987 | Redman | 343/882 |
| 6,361,007 | B1 * | 3/2002 | Oby et al. | 248/285.1 |
| 8,011,628 | B1 * | 9/2011 | Suddeth | 248/225.11 |
| 2002/0190172 | A1 * | 12/2002 | Oddsen, Jr. | 248/289.11 |
| 2005/0001781 | A1 * | 1/2005 | Antoine | 343/878 |

* cited by examiner

*Primary Examiner* — Hoanganh Le
(74) *Attorney, Agent, or Firm* — Max S. Gratton

(57) ABSTRACT

An antenna amount including first, second, and third plates is disclosed. Each of the first and second plates includes a planar section and a flange connected to the planar section. At least one attachment device attaches the first plate to the second plate to form a plate structure. When attached, the planar sections of the first and second plates contact each other. Also, the flanges are parallel to each other, extend in the same direction, and are positioned to abut opposing surfaces of a mounting base. The third plate includes a planar section and a mounting surface connected to the planar section. The mounting surface is configured to receive a mounting device for the antenna. The attachment device clamps the mounting base between the third plate and the plate structure.

20 Claims, 7 Drawing Sheets

STRUCTURES AND METHODS FOR MOUNTING AN ANTENNA

RELATED APPLICATIONS

This application claims priority to U.S. Provisional Application Ser. No. 61/074,352, entitled "STRUCTURES AND METHODS FOR MOUNTING AN ANTENNA", filed Jun. 20, 2008, which is hereby incorporated herein by reference in its entirety.

BACKGROUND

With the introduction of direct-to-home satellite broadcast television systems, such as Direct Broadcast Satellite (DBS) systems, a multitude of television programs, audio channels, and the like previously unknown with terrestrial ("over-the-air") broadcast systems was made accessible to millions of potential subscribers. One aspect of such systems that allows such wide accessibility is the use of a small (e.g., less than one meter in diameter) and inexpensive satellite antenna, or "dish". To effectively employ such an antenna, a subscriber merely provides direct line-of-sight between the dish and the satellites of interest, and supplies a stable mounting platform or base to which the antenna is mounted, such as the exterior of the subscriber's home. The latter requirement helps prevent the antenna from becoming misaligned or misdirected as the result of strong winds or other meteorological conditions, which may cause disruption of the satellite signal carrying the programming.

While the limited size of the antenna has resulted in a large potential subscriber base, significant numbers of potential users remain substantially incapable of deploying a satellite antenna due to the environment surrounding their home. For example, multi-dwelling units (MDUs), such as apartment buildings, condominiums, and townhouses, are often associated with strict rules or covenants regarding private use of the common areas and the building exteriors. More specifically, attachment of a satellite dish to the exterior of a building or a railing is generally forbidden, as affixing the dish to these structures typically requires the drilling of holes or other permanent alterations of the structures.

BRIEF DESCRIPTION OF THE DRAWINGS

Many aspects of the present disclosure may be better understood with reference to the following drawings. The components in the drawings are not necessarily depicted to scale, as emphasis is instead placed upon clear illustration of the principles of the disclosure. Moreover, in the drawings, like reference numerals designate corresponding parts throughout the several views. Also, while several embodiments are described in connection with these drawings, the disclosure is not limited to the embodiments disclosed herein. On the contrary, the intent is to cover all alternatives, modifications, and equivalents.

DETAILED DESCRIPTION

FIGS. 1-8 and the following description depict specific embodiments of the invention to teach those skilled in the art how to make and use the best mode of the invention. For the purpose of teaching inventive principles, some conventional aspects have been simplified or omitted. Those skilled in the art will appreciate variations of these embodiments that fall within the scope of the invention. Those skilled in the art will also appreciate that the features described below can be combined in various ways to form multiple embodiments of the invention. As a result, the invention is not limited to the specific embodiments described below, but only by the claims and their equivalents.

In addition, directional references employed below, such as "up", "down", "left", "right", "back", "front", "upper", "lower", and so on, are provided to relate various aspects of the structures to each other, and are not intended to limit the embodiments disclosed herein to a particular orientation with respect to their surrounding environment.

Figure 1:
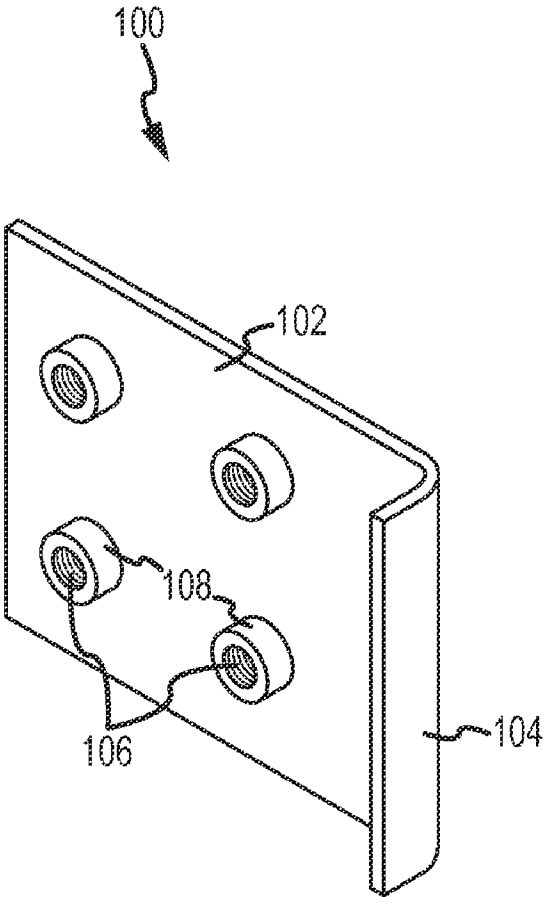
FIG. 1 is a perspective view of a first plate of an antenna mount according to an embodiment of the invention.

FIG. 1 depicts one component of an antenna mount according to one embodiment: a first plate 100 including a substantially planar section 102 and a flange 104. In the specific embodiment of FIG. 1, the flange 104 is formed at an end of the planar section 102, although various locations for the flange 104 may be possible in other examples. The first plate 100 also defines a plurality of holes 106, through which may extend bolts, screws, or other fasteners. In one implementation, the holes 106 are threaded to accept an appropriately sized bolt for securely attaching the first plate 100 to other structures, as is described in greater detail below. In another implementation, a threaded structure 108, such as a nut, may be integrated with the planar section 106 and aligned with each of the holes 106. Further, while four holes 106 are shown in FIG. 1, other numbers of holes may be utilized in other embodiments.

In one embodiment, the first plate 100, as well as the remaining plates described hereinafter, may be fabricated from sheet metal or another material of sufficient strength to resist flexing and deformation, especially under inclement weather conditions, such as strong winds, heavy rains, and the like. Other materials, such as plastic, fiberglass, or composite materials, may be employed in other implementations. Also, the first plate 100, as well as others described below, may be approximately one-eighth to one-sixteen inch thickness, although any other thickness may be utilized so that the plate 100 is fashioned to withstand the gravitational and external forces expected in the environment in which the antenna will be mounted.

Figure 2:
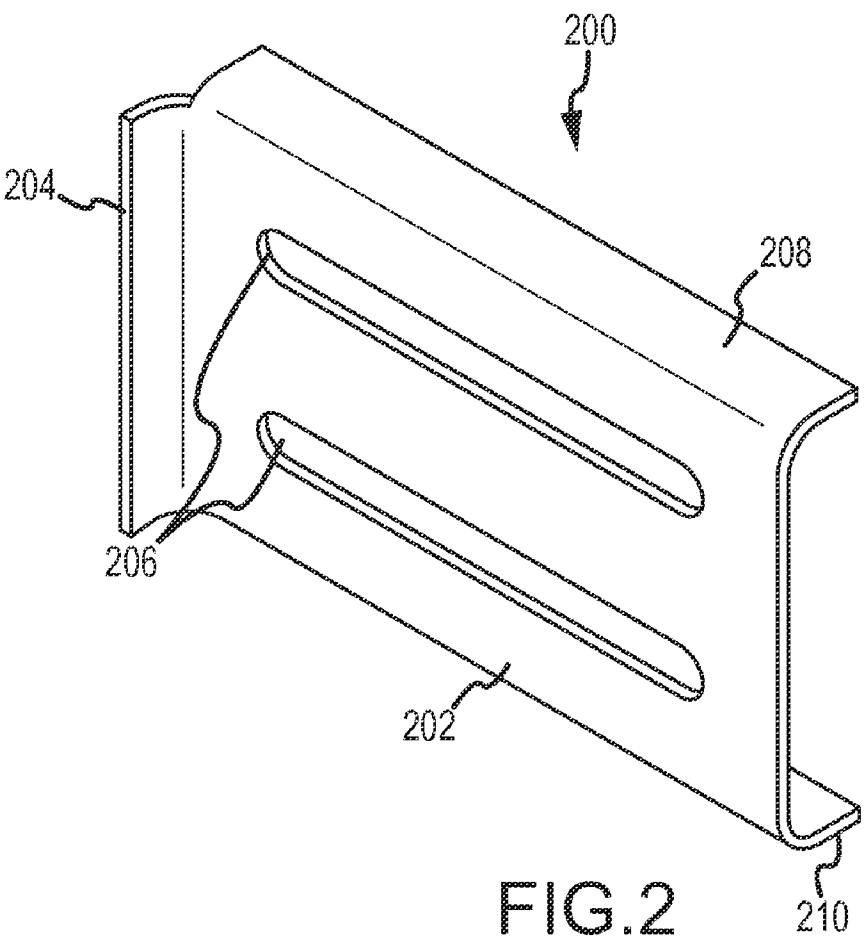
FIG. 2 is a perspective view of a second plate of an antenna mount according to an embodiment of the invention.

FIG. 2 illustrates a second component of an embodiment of the invention: a second plate 200 having a planar section 202 and a flange 204. As with the first plate 100, the flange 204 extends from one end of the planar section 202, although other locations are also possible. Additionally, the planar section 202 defines a pair of slots 206 transverse to the flange 204 for adjustment purposes, as described more fully below.

In the particular example of FIG. 2, an upper extension 208 and a lower extension 210 may extend from opposing edges of the planar section 204 in a direction transverse to that of the flange 204. These extensions 208, 210 may serve to maintain the structural integrity of the planar section 202. The extensions 208, 210 may also be utilized as a registration surface for proper alignment of the second plate 200 with another surface. In other examples, the extensions 208, 210 may be eliminated from the second plate 200.

Figure 3:
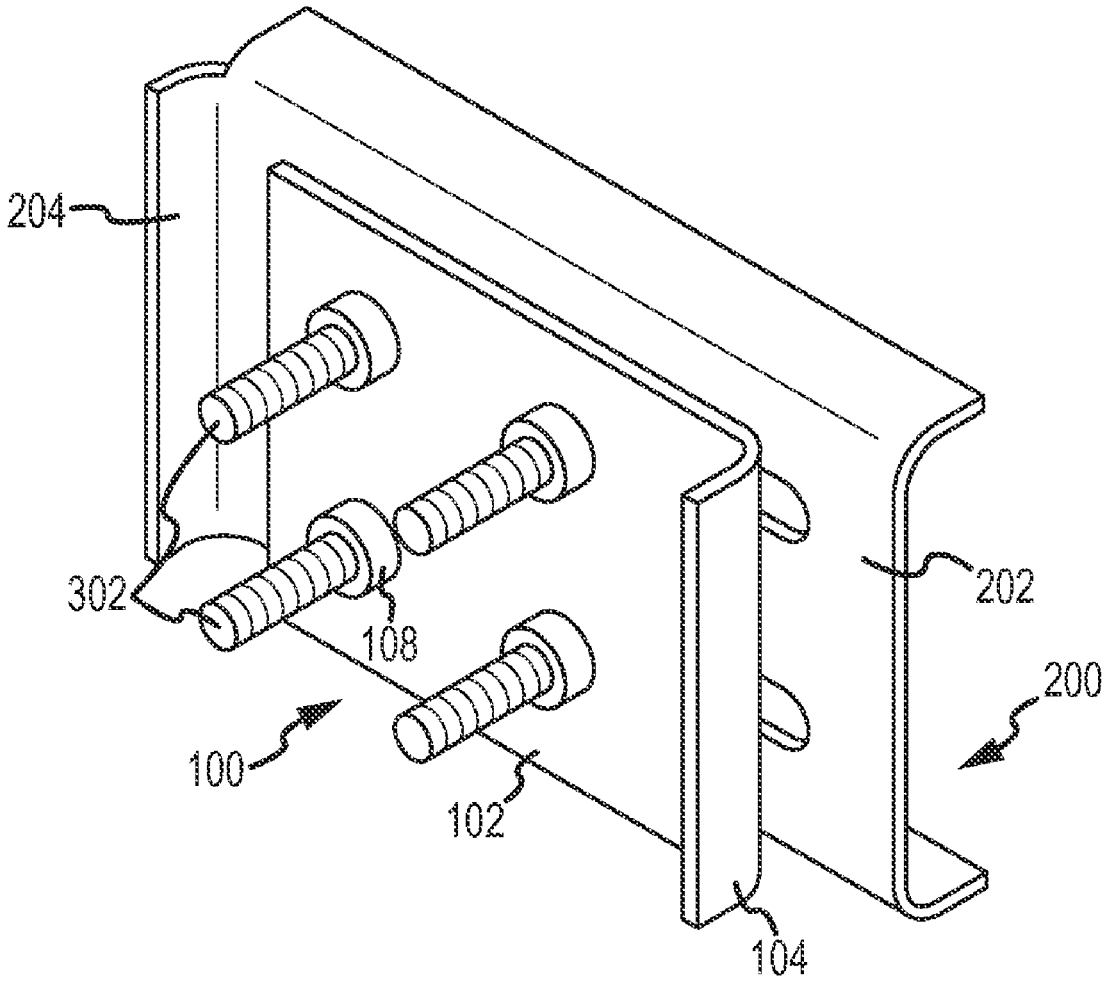
FIG. 3 is a perspective view of the first plate of FIG. 1 and the second plate of FIG. 2 loosely attached together according to an embodiment of the invention.

FIG. 3 provides a perspective view of the first plate 100 and the second plate 200 aligned so that bolts 302 may be inserted through the slots 206 (not viewable in FIG. 3) of the second plate 200 and threaded through the threaded structures 108 of the first plate 100. In another embodiment, the holes 106 of the first plate 100 may themselves be threaded for engagement with the bolts 302. In another example, threaded nuts separate from the first plate 100, including locking nuts, serrated hex head nuts, nuts integrated with lock washers, and the like, may be threaded onto the bolts 302 in order to affix the first plate 100 to the second plate 200. The bolts 302 may first be threaded through another component, such as a washer or lock washer (not shown in FIG. 3), before being inserted through its corresponding slot 206 of the second plate 200 and associated hole 106 of the first plate 100. Such a component may provide a stable surface against which the head of the bolt 302 may exert a tightening force onto the second plate 200.

In FIG. 3, the first plate 100 and the second plate 200 are connected via the bolts 302, but are yet to be rigidly attached together. This arrangement allows the first plate 100 to translate back and forth along the direction of the slots 206 of the second plate 200, thus allowing the distance between the flange 104 of the first plate 100 and the flange 204 of the second plate 200 to be adjusted.

Figure 4:
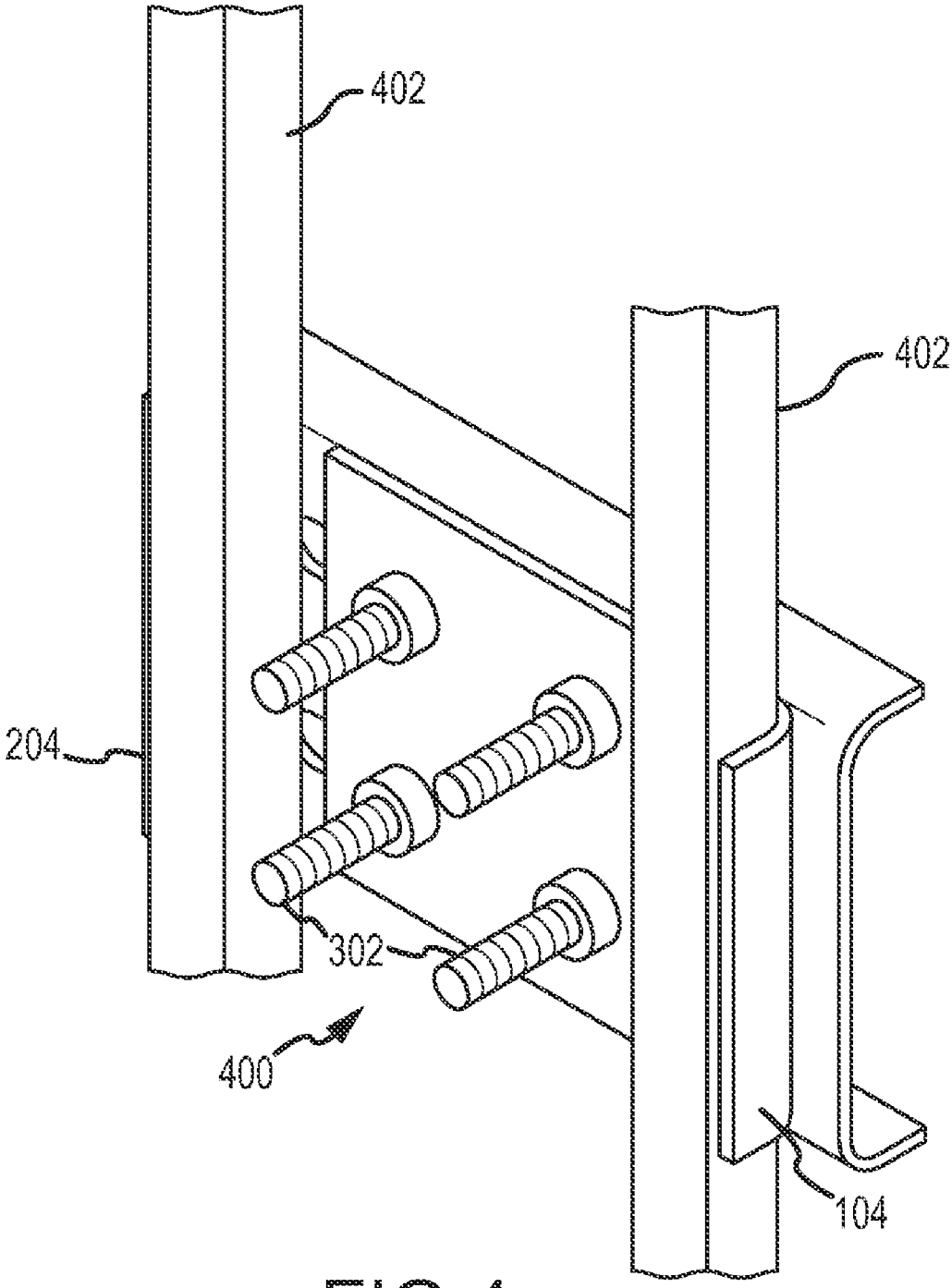
FIG. 4 is a perspective view of the first plate of FIG. 1 and the second plate of FIG. 2 securely affixed together to form a plate structure or assembly according to an embodiment of the invention, wherein the plate assembly is adjusted to span a pair of railing supports.

FIG. 4 provides another view of the first plate 100 and the second plate 200, in which the distance between the flange 104 of the first plate 100 and the flanges 204 of the second plate 200 has been adjusted to contact or abut, and possibly grip, oppositely-facing surfaces of two adjacent support posts 402 of a metal railing or banister. In other examples, the support posts 402 may be manufactured from wood, plastic, fiberglass, or another material. Such a railing may be found at an apartment, condominium, or other multi-dwelling unit. Other environments may provide structures similar to the support posts 402. Once this adjustment has been made, the bolts 302 may be tightened while the first plate 100 and the second plate 200 are held stationary against the posts 402 to rigidly attach the first plate 100 to the second plate 200 to form a plate structure or plate assembly 400. In one example, the flanges 104, 204 may exert enough force on the adjacent support posts 402 to at least temporarily maintain the position of the plate assembly 400 against the posts 402.

The first plate 100 and the second plate 200 may be sized and configured to be adapted to a number of different mounting bases. More specifically, features of the first plate 100 and the second plate 200 that may be modified to accommodate different environments include the number and relative spacing of the holes 106 and slots 206, and the length of the plates 100, 200. For example, if longer spans between adjacent support posts 402 are anticipated, one or both of the plates 100, 200 may each be fashioned to be long enough so that the resulting plate assembly 400 spans at least two adjacent posts 402. Also, the length of the slots 206 may be altered so that the overall length of the plate assembly 400 may be adjusted to fit a predetermined range of distances between posts 402.

In other arrangements, other objects or surfaces may serve as the mounting base to which the first plate 100 and the second plate 200 attach. For example, railing support posts of varying size and width may be utilized as the mounting base. Other vertically- or horizontally-oriented structures located sufficiently close to each other may present another possibility. In other examples, any stable surface or object capable of being placed in contact with the flanges 104, 204 so that the plate assembly 400 may span the object while allowing the two plates 100, 200 to be firmly attached to each other may also be used.

While FIGS. 1-4 specifically depict four bolts 302 engaged with four holes 106 of the first plate 100 and two horizontal slots 206 of the second plate 200, varying numbers of bolts 302, holes 106, and slots 206 may be employed in other implementations while remaining with the scope of the invention. Also, while two bolts 302 and holes 106 are associated with each slot 206, greater or fewer bolts 302 and holes 106 may be used in conjunction with each slot 206 of the second plate 200. In still other embodiments, other types of fasteners, such as screws, clips, clamps, and the like, that are capable of rigidly attaching the first plate 100 and the second plate 200 together may be used in addition to, or as a replacement for, any or all of the bolts 302, holes 106, and slots 206 employed in FIGS. 1-4.

Figure 5:
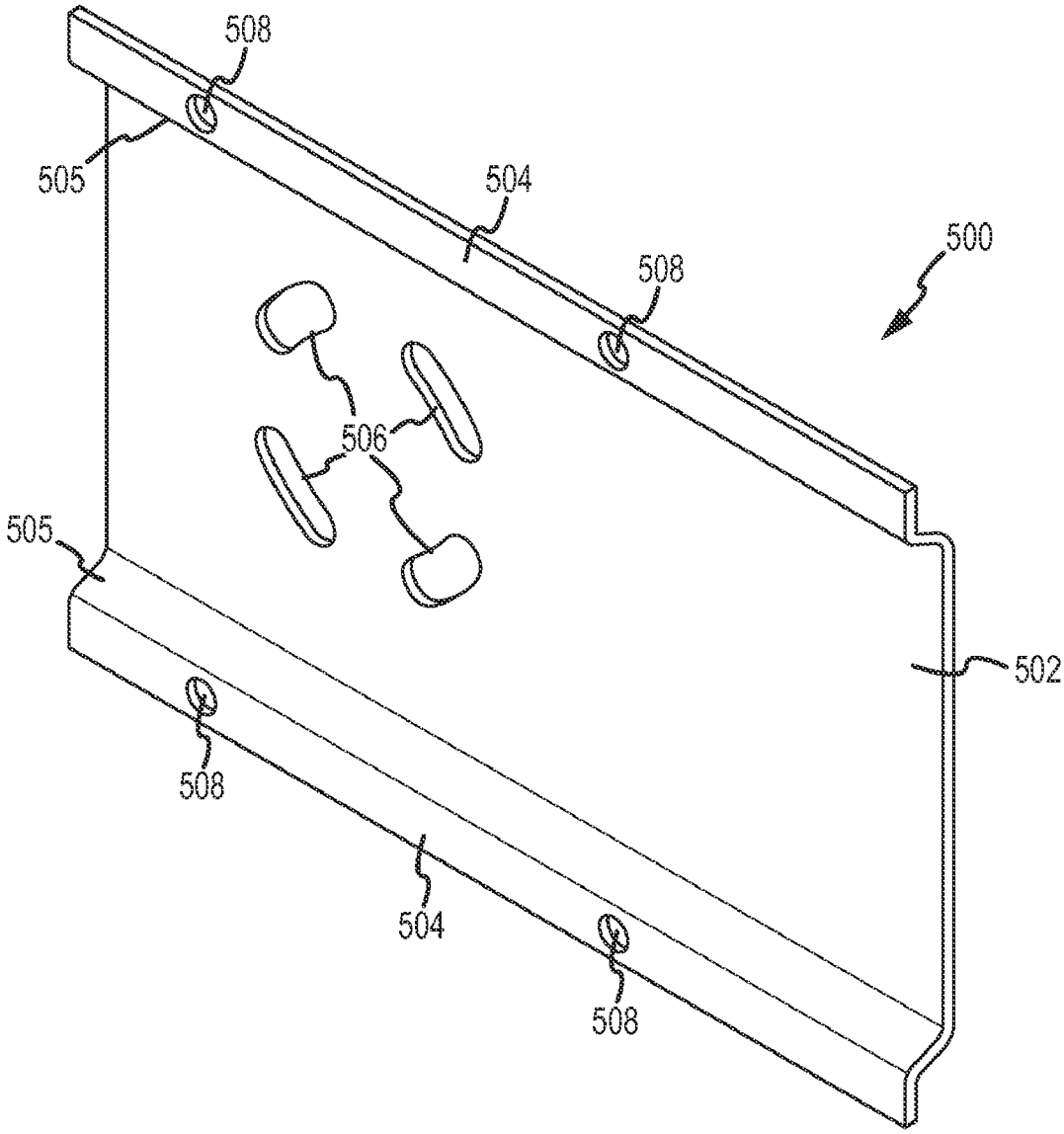
FIG. 5 is a perspective view of a third plate of an antenna mount according to an embodiment of the invention.

FIG. 5 provides a perspective view of another component of the antenna mount in an example of the invention: a third plate 500 to be attached to the plate assembly 400 of FIG. 4. In the specific example of FIG. 5, the third plate 500 includes a planar section 502, and a mounting surface 504 coupled with the planar section 502. In the specific example shown in FIG. 5, the mounting surface 504 includes two separate extension areas, one each at opposing ends of the planar section 502. Further, FIG. 5 depicts angled sections 505 coupling each portion of the mounting surface 504 with the planar section 502. This arrangement results in the mounting surface 504 extensions lying within a plane slightly removed from the plane of the planar section 502.

The mounting surface 504 defines a number of holes 508 for receiving bolts (not shown in FIG. 5) for attaching a mounting device thereto. An example of the mounting device is discussed in greater detail below. While the specific example of FIG. 5 displays four holes 508, varying numbers of holes 508 may be included in other implementations. Also, similar to the holes 106 of the first plate 100, the holes 508 may include threads for receiving the mounting bolts. In another example, a threaded nut associated with each of the holes 508 may be integrated with the mounting surface 508 to receive the bolts. In another implementation, separate nuts, such as locking nuts, serrated hex head nuts, nuts integrated with lock washers, and so on, may be threaded onto the bolts to affix the mounting device to the third plate 500.

The planar section 502 of the third plate 300 includes a number of openings 506 through which the bolts 302 extending from the plate assembly 400 of FIG. 4 may protrude. In the illustration of FIG. 5, the opening 506 are curvilinear slots 506 oriented about a center of the planar section 502, thus allowing the third plate 500 to be skewed about the center of the planar section 502 into relation to the plate assembly 400 before being rigidly attached to the assembly 400. In one example, this skewing or rotation allows the third plate 500 to be oriented vertically when the plate assembly 400 is attached to a mounting base, such as a support post 402, that is not oriented in such a manner. Generally, the amount of skew allowed is determined at least in part by the length of each of the curvilinear slots 506.

Figure 6:
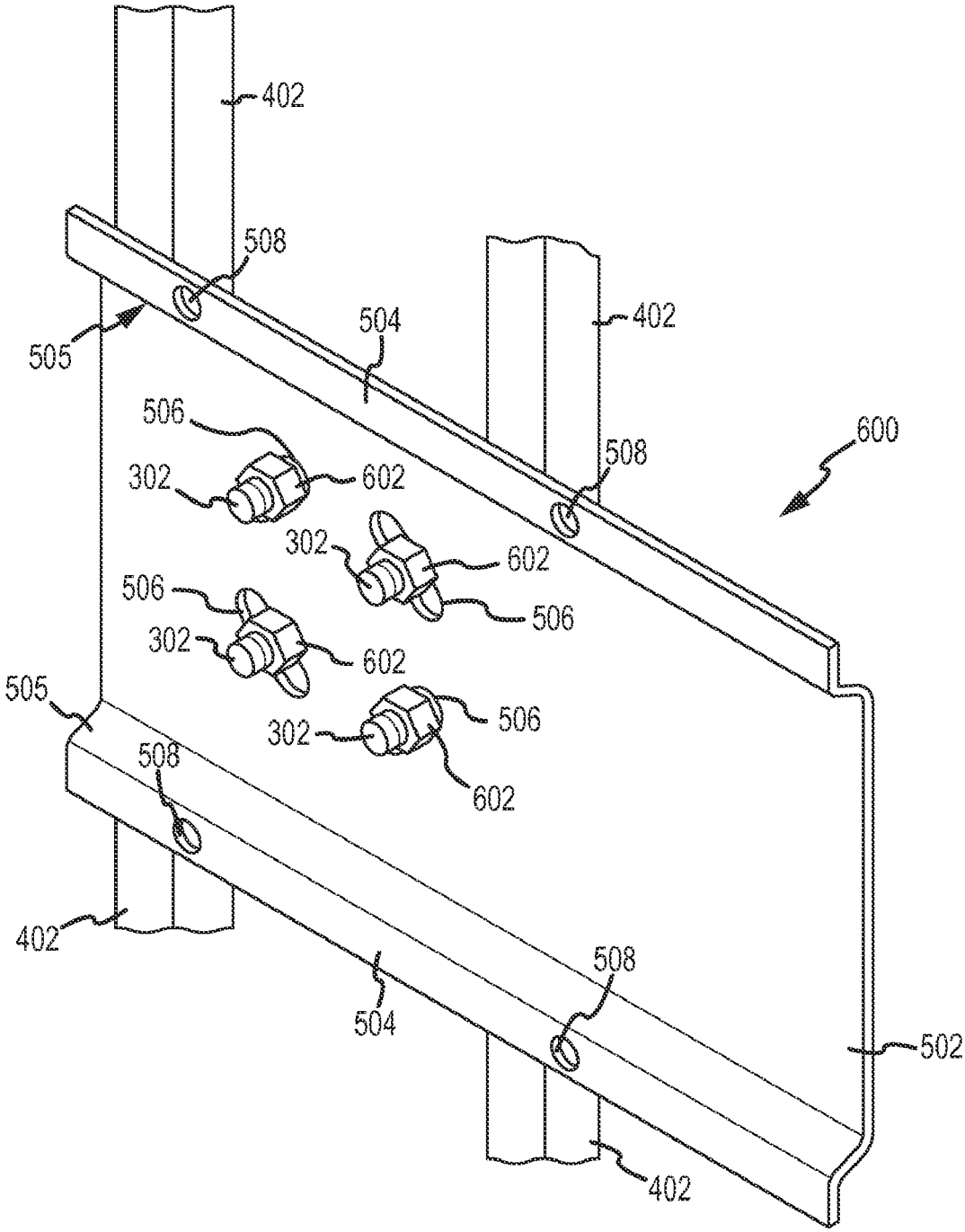
FIG. 6 is a perspective diagram of the third plate attached to the plate assembly of FIG. 4 according to an embodiment of the invention.

FIG. 6 provides a view of the third plate 500 securely affixed to the plate assembly 400 (obscured from view in FIG. 6) by nuts 602 threaded onto the bolts 302 extending from the plate assembly 400, and subsequently tightened. The resulting structure constitutes an antenna mount 600. By attaching the third plate 500 to the plate assembly 400 in this manner, the third plate 500 and the plate assembly 400 essentially clamp the support posts 402 therebetween, forming a stable connection between the antenna mount 600 and the posts 402. Ordinarily, the nuts 602 initially will be threaded loosely onto the bolts 302, the third plate 500 will be rotated into the desired orientation, and then the nuts 602 will be tightened to maintain the selected orientation for the third plate 500.

As with the formation of the plate assembly 400, the third plate 500 may be affixed to the plate assembly 400 by means other than bolts and nuts, such as screws, clips, clamps, and the like, while remaining with the scope of the present invention.

Figure 7:
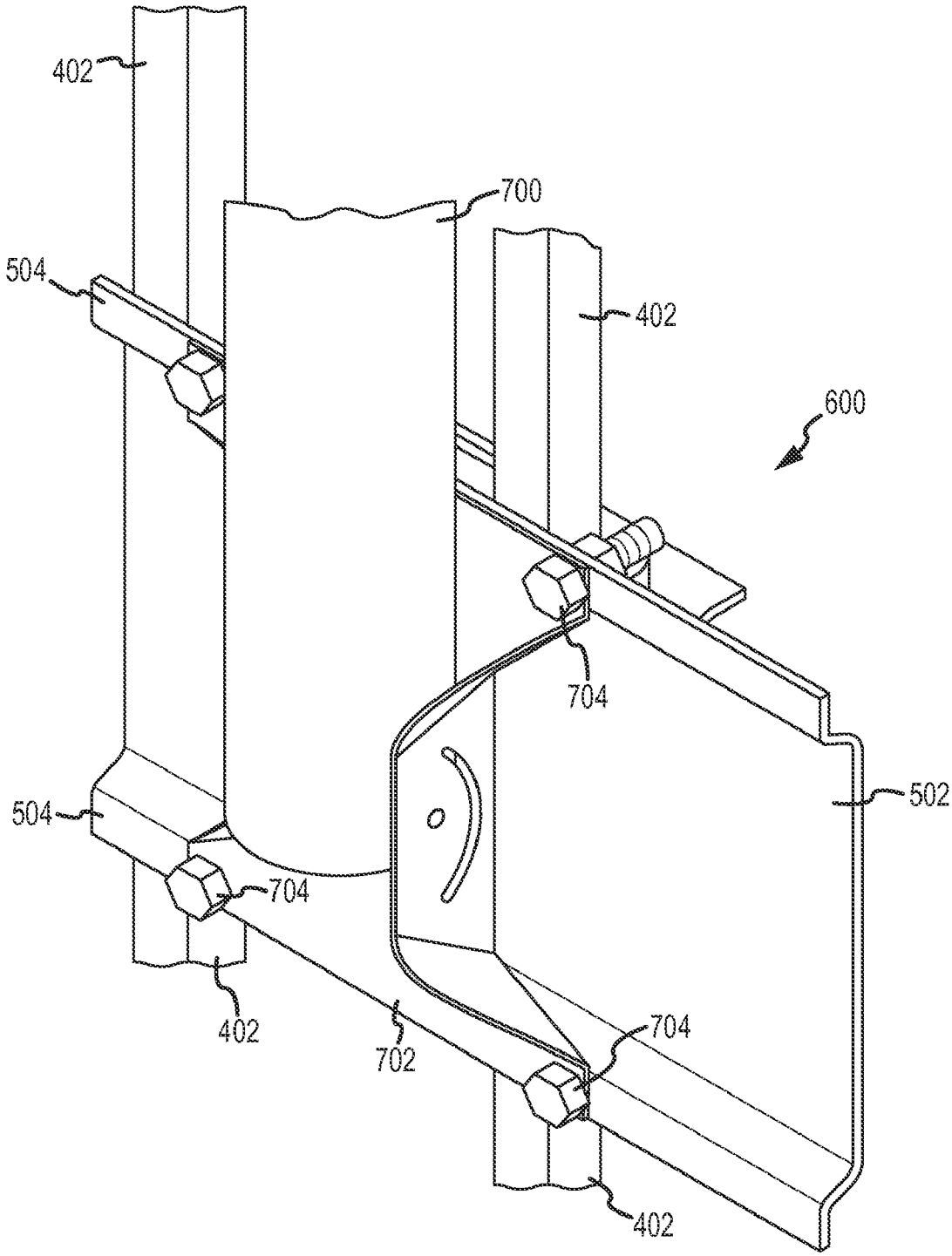
FIG. 7 is a perspective diagram of an antenna mast according to an embodiment of the intention, wherein a foot of the antenna mast is affixed to the third plate of FIG. 6.

With the antenna mount 600 firmly attached to the posts 402 (or other mounting base), hardware necessary for mounting an antenna to the antenna mount 600 may be attached to the mount 600. FIG. 7 illustrates an example of an antenna mast 700 having a foot section 702 configured to attach to the mounting surface 504 of the third plate 500. In this example, the mast 700 is oriented vertically for attachment with a dish antenna, such as what may be used in conjunction with a satellite broadcast television receiver. In other embodiments, other types of mounting devices or hardware adapted specifically for a particular type of antenna, such as a satellite broadcast television or radio receiver antenna, a terrestrial (over-the-air) broadcast television or radio receiver antenna, a two-way radio communication antenna, and so on, may be employed to attach such an antenna with the mounting surface 504. Such devices may not incorporate a foot or mast, but may include other structures for appropriately mounting the antenna of choice for a particular application.

In FIG. 7, bolts 704 are threaded through or into the holes 508 of the mounting surface 504 of the third plate 500 to securely attach the foot 702, and thus the antenna mast 700, to the antenna mount 600. If the holes 508 are threaded, or correspond with integrated nuts or similar structures, the bolts 704 may be tightened to affix the foot 702 to the mounting surface 504. In the case the holes 508 are not threaded, or do not have integrated nuts associated therewith, conventional nuts (not shown in FIG. 7) may be threaded onto the bolts 704 and tightened. Also, other means of attaching the foot 702 of the mast 700 to the third plate 500, such as screws, clips, clamps, and other fasteners or attachment devices, may be utilized in other implementations.

In one embodiment, the components discussed above constituting the antenna mount 600 (i.e, the first plate 100, the second plate 200, and the third plate 500) may be provided as a kit to be assembled by a purchaser or installer. In one example, the kit may also contain the various attachment devices, such as bolts, nuts, screws, clips, clamps, or the like, to attach the various plates 100, 200, 500 together as described above.

Figure 8:
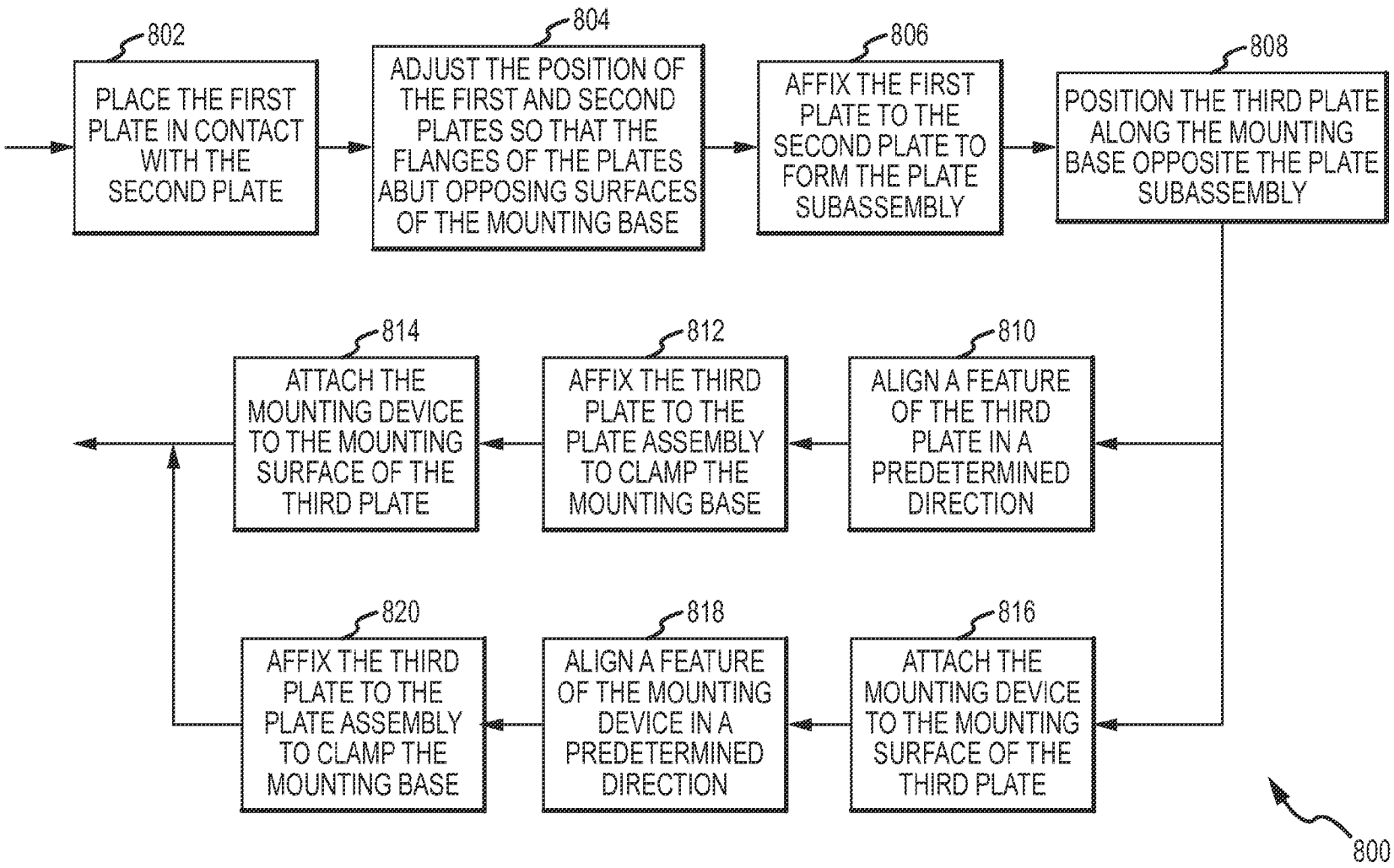
FIG. 8 is a flow diagram of a method according to an embodiment of the invention of mounting an antenna.

FIG. 8 presents a flow diagram of a method 800 for assembling the various pieces of a kit as described above to form a functioning antenna mount according to an embodiment of the invention. At least some of the operations of FIG. 8 are described in some detail above. First, the first plate 100 is placed in contact with the second plate 200 (operation 802). The plates 100, 200 are positioned such that the planar section 102 of the first plate 100 and the planar section 104 of the second plate 200 are parallel to each other, and the flanges 104, 204 of the plates 100, 200 are parallel to each other and extend in the same direction, as indicated in FIG. 3. In one example, bolts 302 may be installed through the openings 106, 206 of the first and second plates 100, 200 to maintain somewhat the orientation of the plates 100, 200.

The relative position of the first plate 100 and the second plate 200 is then adjusted so that the flanges 104, 204 abut opposing surfaces of a mounting base (operation 804). In the specific example of FIG. 3, the opposing surfaces are sides of the support posts 402 described above, although other mounting bases may be employed to similar end. The first plate 100 is then affixed to the second plate 200 to form the plate subassembly 400 (operation 806). Typically, this operation occurs while the first plate 100 and the second plate 200 are abutted against the posts 402 or other mounting base, thus potentially allowing the posts 402 to retain the plate subassembly 400.

The third plate 500 is then positioned along the mounting base (e.g., the support posts 402) opposite the plate assembly 400 (operation 808). The planar section 502 of the third plate 500 is thus parallel to the planar sections 102, 202 of the first plate 100 and the second plate 200.

At this point, the third plate 500 is attachable to the plate assembly 400. To ensure proper alignment of the third plate 500 to allow attachment of a mounting device, such as the mast 700 and connected foot 702 shown in FIG. 7, at least two different approaches may be followed. In one example, a feature of the third plate 500, such as an edge of the third plate 500, is aligned in a predetermined direction, such as a vertical or horizontal direction (operation 810), such as by the use of a level or similar tool. The third plate 500 is then affixed to the plate assembly 400 to clamp the resulting antenna mount 600 to the posts 402 or other mounting base (operation 812), as shown in FIG. 6. The mounting device, such as the mast 700, may then be attached to the mounting surface 504 of the third plate 500 (operation 814), as illustrated in FIG. 7.

In another embodiment, after the third plate 500 has been positioned along the mounting base opposite the plate assembly 400, and attached loosely thereto with the bolts 302 or other attachment devices, the mounting device (e.g., the mast 700) may be attached to the mounting surface 504 of the third plate 500 (operation 816). A feature of the mounting device, such as a surface of the mast 700, may then be aligned in a predetermined direction, such as a vertical or horizontal direction (operation 818). Once this alignment is complete, the third plate 500 may be securely affixed to the plate assembly 400 to clamp the posts 402 therebetween (operation 820). In various applications, other methods for assembling the antenna mount 600 and attaching a mounting device and antenna thereto may also be possible.

Various embodiments as described herein may provide a number of benefits. Generally, the antenna mount as disclosed herein allows the secure and stable installation of an antenna, such as a DBS dish antenna, to a railing or other potential mounting base without imposing damage, such as drilled holes, normally resulting from mounting an antenna. This particular benefit provides potential communication service subscribers in multi-dwelling units, such as apartments, condominiums, and the like, the ability to secure a satellite antenna or similar device without running afoul of community rules. Similarly, other users may employ the antenna mount and methods described herein to provide a stable platform for their antenna or other equipment without inflicting damage on their own property.

While several embodiments of the invention have been discussed herein, other embodiments encompassed by the scope of the invention are possible. For example, while various embodiments have been described primarily within the context of satellite, cable, and terrestrial antenna systems and similar equipment, any object requiring a stable platform, including signage, lighting, and so on, may benefit from the implementation of the principles described herein, with respect to both outdoor and indoor applications. In addition, aspects of one embodiment disclosed herein may be combined with those of alternative embodiments to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. A kit for an antenna mount, comprising:

a first plate comprising a planar section and a flange connected to the planar section;

a second plate comprising a planar section and a flange connected to the planar section; and a third plate comprising a planar section and a mounting surface connected to the planar section, wherein the mounting surface is configured to receive a mounting device for an antenna;

wherein the first plate is configured to be attached to the second plate to form a plate structure so that the planar sections of the first and second plates contact each other, the flanges are parallel to each other and extend in the same direction, and a distance between the flanges is adjustable to allow the flanges to abut opposing surfaces of a mounting base; and wherein the third plate is configured to be attached to the plate structure to clamp the mounting base therebetween.

2. The kit of claim 1, further comprising:

an attachment device configured to attach the first plate to the second plate.

3. The kit of claim 2, wherein:

the attachment device is configured to attach the third plate to the plate structure.

4. The kit of claim 2, wherein:

the attachment device comprises a plurality of bolts;

the planar section of the first plate defines a plurality of threaded holes;

the planar section of the second plate defines a plurality of slots;

each of the plurality of bolts is configured to extend through one of the slots and be threaded into one of the holes to secure the first plate to the second plate; and the slots are configured to allow the distance between the flanges to be adjusted before the first plate is secured to the second plate.

5. The kit of claim 4, wherein:

the attachment device further comprises a plurality of nuts;

the planar section of the third plate defines a plurality of openings, with each of the openings being aligned with one of the plurality of bolts; and each of the plurality of nuts is configured to be threaded onto a corresponding one of the bolts to clamp the mounting base between the third plate and the plate structure.

6. The kit of claim 5, wherein:

the openings of the third plate comprise slots configured to allow the third plate to be skewed in relation to the plate structure when the mounting base is clamped between the third plate and the plate structure.

7. The kit of claim 1, wherein:

the mounting surface comprises first and second extensions coupled to opposing edges of the planar section of the third plate; and the first and second extensions are coplanar, and are parallel to the planar section of the third plate.

8. The kit of claim 1, wherein:

the mounting surface defines a plurality of holes configured to receive a second attachment device for attaching the mounting device for the antenna to the mounting surface.

9. The kit of claim 8, wherein:

the second attachment device comprises a second plurality of bolts; and the plurality of holes defined by the mounting surface further comprise threads for receiving the second plurality of bolts for attaching the mounting device for the antenna to the mounting surface.

10. The kit of claim 1, further comprising:

the mounting device for the antenna.

11. The kit of claim 10, wherein:

the mounting device comprises a mast for the antenna; and the mast comprises a foot configured to be attached to the mounting surface of the third plate.

12. The kit of claim 1, wherein:

the mounting base comprises support posts of a railing, wherein each of the flanges is configured to abut a separate one of the support posts.

13. A method of mounting an antenna, comprising:

placing a first plate in contact with a second plate, wherein the first and second plates each comprise a planar section and a flange connected to the planar section, wherein the planar sections of the first and second plates are parallel to each other, and the flanges are parallel to each other and extend in the same direction;

adjusting the relative position of the first and second plates so that the flanges abut opposing surfaces of a mounting base;

affixing the first plate to the second plate to form a plate subassembly;

positioning a third plate along the mounting base opposite the plate assembly, wherein the third plate comprises a planar section and a mounting surface connected to the planar section, wherein the mounting surface is configured to receive a mounting device for an antenna, and wherein the planar section of the third plate is parallel to the planar sections of the first and second plates; and affixing the third plate to the plate assembly so that the third plate and the plate assembly clamp the mounting base therebetween.

14. The method of claim 13, further comprising:

aligning a feature of the third plate in a predetermined direction before affixing the third plate to the plate assembly; and attaching the mounting device to the mounting surface of the third plate after affixing the third plate to the plate assembly.

15. The method of claim 13, further comprising:

attaching the mounting device to the mounting surface of the third plate; and aligning a feature of the mounting device in a predetermined direction after attaching the mounting device to the mounting surface of the third plate, and before affixing the third plate to the plate assembly.

16. An antenna mount, comprising:

a first plate comprising a planar section and a flange coupled to the planar section;

a second plate comprising a planar section and a flange coupled to the planar section;

at least one attachment device attaching the first plate to the second plate to form a plate structure so that the planar sections of the first and second plates contact each other, and so that the flanges are parallel to each other, are extending in the same direction, and are abutted to opposing surfaces of a mounting base; and a third plate comprising a planar section and an mounting surface coupled to the planar section, wherein the mounting surface is configured to receive a mounting device for an antenna;

wherein the attachment device attaches the third plate to the plate structure to clamp the mounting base between the third plate and the plate structure.

17. The antenna mount of claim 16, wherein:

the at least one attachment device comprises a plurality of bolts and a plurality of nuts;

the planar section of the first plate defines a plurality of threaded holes;

the planar section of the second plate defines a plurality of slots;

each of the plurality of bolts extends through one of the slots and threaded into one of the holes to secure the first plate to the second plate;

the planar section of the third plate defines a plurality of slots; and each of the plurality of nuts is threaded onto a corresponding one of the bolts to secure the third plate to clamp the mounting base between the third plate and the plate structure.

18. The antenna mount of claim 16, wherein:

the mounting surface comprises first and second extensions connected to opposing edges of the planar section of the third plate; and the first and second extensions are coplanar, and are parallel to the planar section of the third plate.

19. The antenna mount of claim 16, further comprising:

the mounting device for the antenna, wherein the mounting device is rigidly attached to the mounting surface of the third plate.

20. The antenna mount of claim 19, wherein:

the mounting device comprises a mast for the antenna; and the mast comprises a foot attached to the mounting surface of the third plate.

* * * * *